United States Patent [19]

Walsh

[11] Patent Number: 4,760,492

[45] Date of Patent: Jul. 26, 1988

[54] COMBINED FORM FEED AND STORAGE, PRINTER STAND AND CARRYING CASE

[76] Inventor: Frances C. Walsh, 2 Deer Run Rd., Poughkeepsie, N.Y. 12603

[21] Appl. No.: 107,711

[22] Filed: Oct. 13, 1987

[51] Int. Cl.[4] ..... H05F 1/00; A47B 83/04; B41J 29/02

[52] U.S. Cl. ..... 361/214; 312/208; 400/691

[58] Field of Search ..... 361/212, 214; 312/208, 312/241, 244, 277; 400/691, 690.1, 690.2, 690.3, 690.4

[56] References Cited

U.S. PATENT DOCUMENTS 4,474,457 10/1984 Phelps ..... 361/214 X 4,522,521 6/1985 Scott ..... 400/691

4,602,310 7/1986 Fenster ..... 361/212

4,645,275 2/1987 Pucci ..... 312/208 X 4,681,378 7/1987 Hellman ..... 312/208 X

*Primary Examiner*—Donald A. Griffin

*Attorney, Agent, or Firm*—Biebel, French & Nauman

[57] ABSTRACT

A dual wall case which serves as a storage, shipping and carrying case for a computer printer, a storage and feed unit for computer printer paper and a computer printer stand. The case is preferably constructed of a blow molded plastic having a sufficient degree of conductivity to permit static electricity on the paper to be discharged through a ground wire attached to the case as the paper passes over supporting surfaces of the case.

18 Claims, 3 Drawing Sheets

COMBINED FORM FEED AND STORAGE, PRINTER STAND AND CARRYING CASE

BACKGROUND OF THE INVENTION

With the broad popularization of computers, particularly personal computers, and the use of printers, which are normally considered a necessary adjunct of such computers, the storage and feeding of continuous webs, usually in a fan-folded configuration, to the computer has been left largely to the ingenuity of the computer operator. Some attempts have been made to solve the problem of storage and feeding, as indicated by U.S. Pat. No. 4,458,814, which discloses a packing assembly for fan-folded printer webs, and U.S. Pat. No. 4,651,967 which shows a stand which can accommodate a printer and a supply of fan-folded printer paper. Also, U.S. Pat. No. 4,522,521 describes a printer stand including a storage area for fan-folded paper which also addresses the problem of computer printer paper storage and feeding.

Additionally, in the feeding of a continuous web of paper for any purpose, it is common for a substantial amount of static electricity to be generated, and a number of prior art devices have addressed this problem. See, for example, the early U.S. Pat. No. 1,573,414 for a static eliminator for use in conjunction with printing devices, another early U.S. Pat. No. 1,668,049, which is directed to a deelectrolizer for removing charges of static electricity from printing papers, U.S. Pat. No. 2,445,271 for static eliminating means, also useful with printing papers, U.S. Pat. No. 3,636,408 for a tape dispenser with a static electricity neutralizer, U.S. Pat. No. 3,757,164 directed to a neutralizing device for reducing the potential of static electrical charges present on a web of paper, U.S. Pat. No. 3,921,037, covering a moving web energized static eliminator, U.S. Pat. No. 4,073,001, disclosing apparatus for neutralizing and registering an electrostatically charged sheet, and U.S. Pat. No. 4,494,166, illustrating a printing machine with a static elimination system.

It will also be noted that U.S. Pat. No. 4,645,275 describes and claims a portable carrying case and sound shield for a printer with a self-contained support stand, which is said to protect a printer carried therein and is convertible from a carrying case into a printer stand.

Despite this intense activity in dealing with problems associated with printers, the storage and feeing of paper to printers and the dissipation of static electricity associated with feeding continuous paper webs, none of the prior art appears to have addressed these multiple problems in a single, inexpensive and yet efficient, combined portable unit.

SUMMARY OF THE INVENTION

In accordance with the present invention a compact, combined form feed and storage, printer stand and carrying case is provided which performs all of the functions considered desirable, not only in the feeding and storage of continuous paper webs to a printer, but also the transportation of the printer itself and its support during printing operations.

Thus, in accordance with the present invention a single compact unit, which may be conveniently formed of a blow-molded synthetic resinous material, includes a carrying case within which a printer, particularly a computer printer, can be stowed for transportation and/or storage, but which can also accommodate a continuous web of printer paper, typically in a fan-folded configuration, when the printer is removed from the case and positioned upon it while functioning as a printer stand.

The unit is preferably of dual walled construction, which can be readily manufactured by a blow molding process, and the resultant construction provides an inherent cushioning effect that protects a printer carried in the case from damage due to impact forces.

The combined unit of the present invention, in its printer stand-form feed and storage configuration, is provided with means defining a continuous printer paper path from adjacent the front end of the stand to the rear thereof, from whence the paper can be trained into the top of a printer positioned on the stand in a conventional manner.

In those instances where the printer is of the type which accepts paper at a medial point on its under surface, the combined unit in accordance with the present invention includes a convertible feature which allows the paper feed to be directed upwardly into a lower feed slot on a printer of this type.

The combined form feed and storage, printer stand and carrying case disclosed herein has a front access door which may be opened and, in cooperation with the hinged and lower sections of the stand, provides access to the interior of the stand while the printer is still supported by it to, for example, replenish the supply of paper carried within the stand. Additionally, the front access door may be provided with a window so that an operator can view when the supply of paper is about to be exhausted and replenish it as necessary.

Preferably the combined form feed and storage, printer stand and carrying case of the present invention is formed of a conductive material, which, in conjunction with a suitable grounding assembly and contact surfaces over which the paper is trained as it passes from storage to a printer, provides harmless discharge of static electricity that may be associated with the feeding of the continuous web of paper.

These and other advantages and features of the present invention will become more apparent from the following detailed description.

DESCRIPTION OF THE PREFERRED EMBODIMENT

Figure 1:
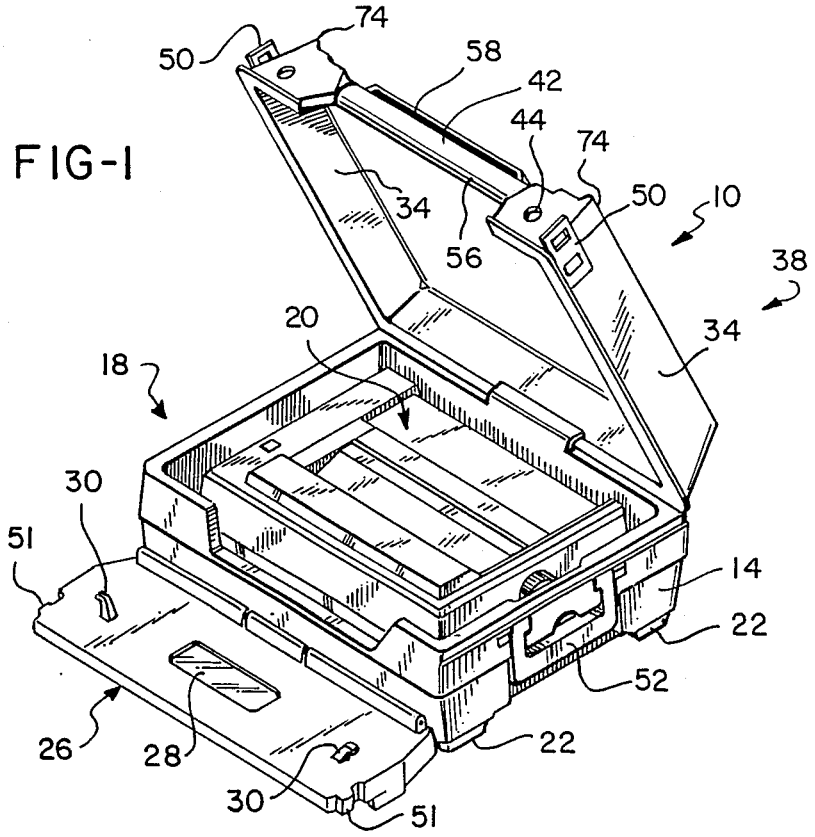
FIG. 1 is a perspective view of the combined form feed and storage, printer stand and carrying case of the present invention showing a typical computer printer nested therein.
Figure 2:
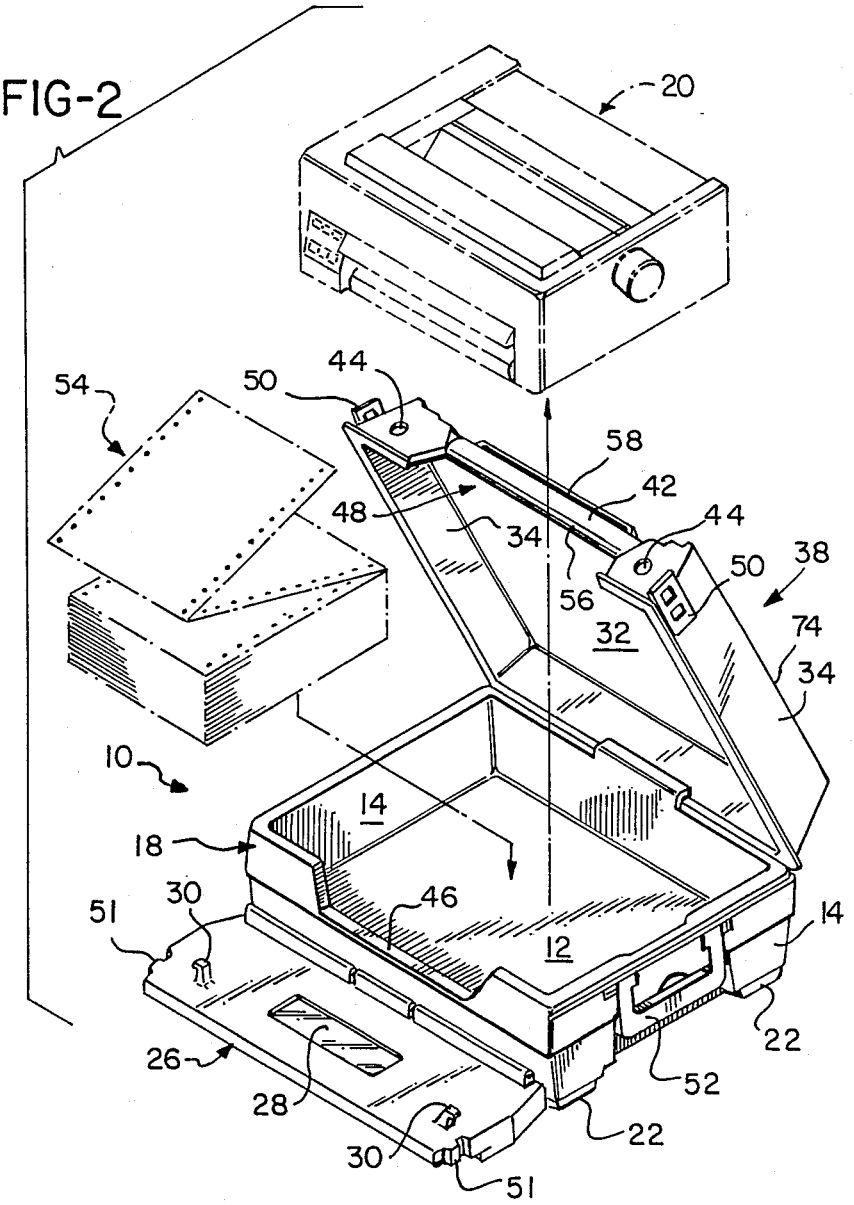
FIG. 2 is an exploded perspective view showing the printer removed from the case and a supply of fan-folded computer paper about to be inserted in its place.
Figure 3:
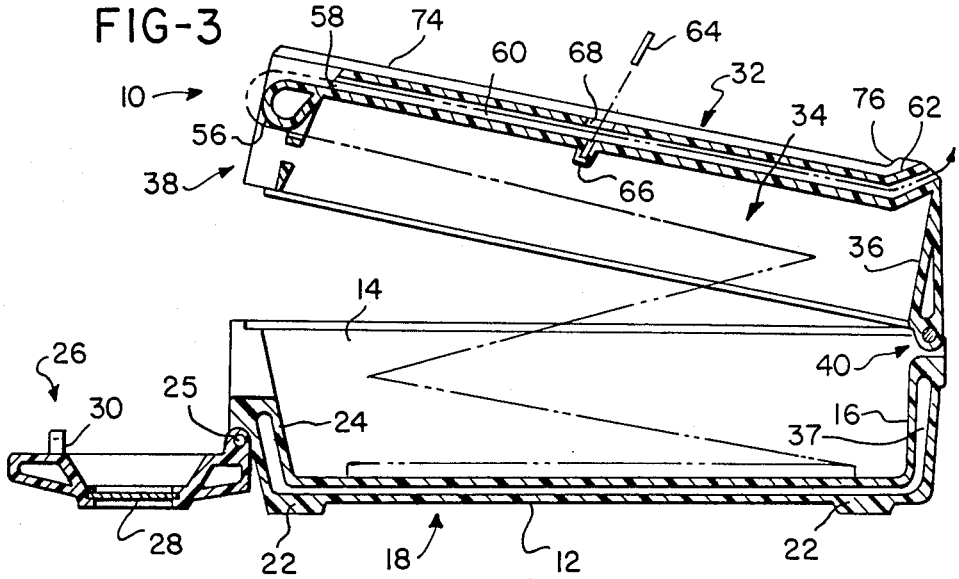
FIG. 3 is a cross-sectional view illustrating the dual walled cushioning construction of the case and showing the paper path from storage to a printer, not shown, which may be positioned upon the case.

With reference initially to FIGS. 2 and 3 of the drawings, it will be seen that the combined form feed and storage, printer stand and carrying case 10 of the present invention includes a dual bottom wall 12, a pair of side walls 14, which are also of dual construction similarly to bottom wall 12, and which extend upwardly from opposite sides of the bottom wall and a dual rear wall 16 extending upwardly from a rear edge of the bottom wall and defining with it and the side wall a hollow base 18 of sufficient length and width to accommodate, as seen in FIG. 1 of the drawings, a printer 20 therein.

It will also be noted that the bottom wall 12 is conveniently provided with feet 22, which may rest upon any supporting surface, or, as will be more readily apparent as the description proceeds, permit two or more cases in accordance with the present invention to be stacked in nested relationship, thereby permitting multiple form feed and storage.

As best seen in FIG. 3 of the drawings, a short, upwardly extruding dual wall 24 is hingedly connected at 25 to a front cover 26, which may be provided with a window 28 and lugs or bosses 30 for a purpose presently to be described. The hinge connection 25 may be formed integrally with the front wall and front cover, or attached separately as desired.

The case 10 also includes a dual top wall 32 having a pair of dual upper side walls 34 depending downwardly from opposite sides thereof and a rear wall 36 having a hollow section 37 depending downwardly from a rear edge of the top wall and defining a hollow cover 38 complementary to the hollow base.

A hinge connection 40, which, similarly to the hinge connection 25, may either be molded integrally with the base and cover or attached separately as desired, interconnects the base and cover adjacent their rear walls to permit pivoting movement of the cover with respect to the base as shown in FIGS. 1, 2 and 3 of the drawings.

Figure 5:
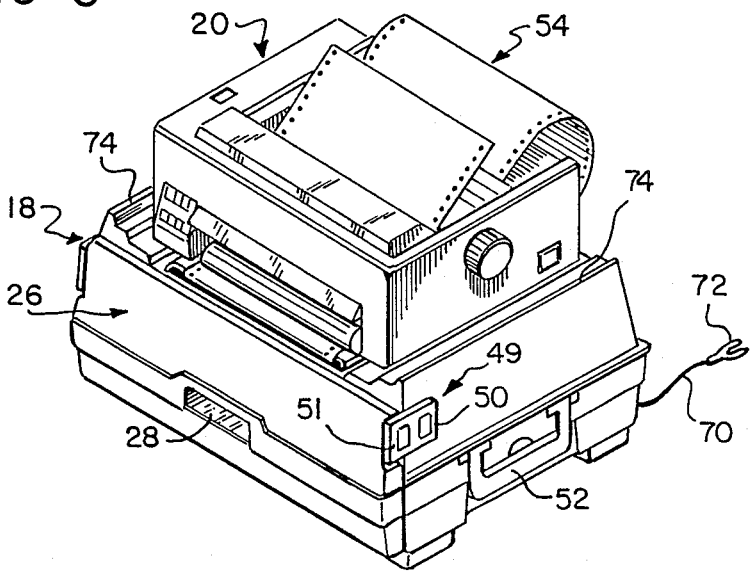
FIG. 5 is a perspective view showing the case serving as both a form feed and storage device, but also serving as a printer stand with a sheet of printer paper trained from the case and around the printer roller.
Figure 4:
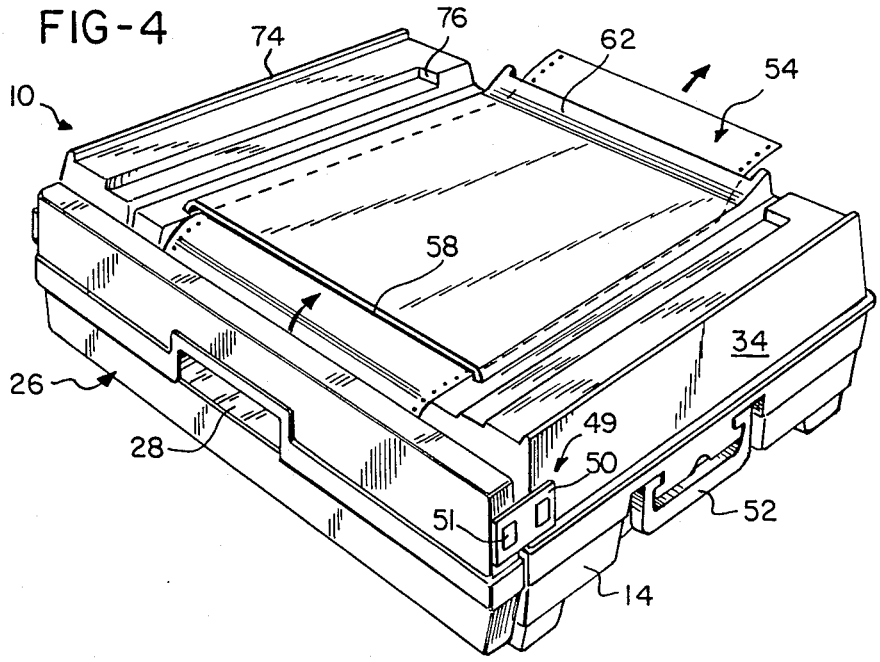
FIG. 4 is a perspective view showing the case in a storage and feed configuration.

The cover 38 is also provided with a front wall 42 having openings 44 aligned with the lugs or bosses 30 and adapted to receive them when the front cover 24 is pivoted upwardly to the position shown in FIGS. 4 and 5 of the drawings. Additionally, both the front walls 24 and 42 have relieved portions 46 and 48, respectively, which define a front opening into the case 10, which may be closed by the front cover 26, but provides access to the paper and permits the contents of the case to be observed during operation.

When the front cover 26 is pivoted up into its closed position latches 49, including receivers 50 and complementary projections 51, only one latch being visible in each of FIGS. 1, 2, 4 and 5, engage and hold the front cover in the closed position and thus, through the cooperation of the lugs 30 and openings 44 and latches 49, lock the base 18, cover 38 and front cover 26 together and prevent their inadvertent separation. This is particularly when the case is used as a carrying case, utilizing a handle 52, or a shipping case. As indicated previously, the dual walled construction of the case provides cushioning of a printer when the unit is functioning as a carrying or shipping case.

With this construction it will be seen that a manufacturer or distributor of the printer 20 can conveniently package the printer, peripherals, wire, manuals, etc., in the case 10 of the present invention, a consumer may have it delivered in this manner or simply pick it up at a point of sale or rental and carry it to his or her office or home utilizing the carrying handle 52, and then set the printer up in the manner described below.

Thus, as seen in FIG. 2 of the drawings, the cover is opened, the printer 20 removed, and replaced by a supply 54 of paper, which will typically be sold in the fan-folded configuration shown.

The leading edge of the paper is then trained, as seen in FIG. 3, about the elongated curved front supporting surface 56, into the slot 58 extending across the width of the cover, through the channel 60 extending from the front to the back of the cover, and thence outwardly across an upwardly extending ramp 62 defining a rear supporting means adjacent the rear wall 36 of the cover, as also shown in FIG. 4 of the drawings.

Assuming the printer is of the type which accepts paper in its upper surface from whence it is trained around a roller as shown in FIG. 5 of the drawings, the printer 20 is positioned on the case and the paper exits about the ramp 62 to the printer in the manner shown.

Not all printers accept paper in this manner and in some cases paper will be fed to a printer through its under surface. For printers of this type the case of the present invention can be readily modified, as shown in FIG. 3 of the drawings, by the insertion of a ramp 64 which has its lower end received in a pocket 66 molded into the cover and extends upwardly through an opening 68 to permit the paper to be fed through a mid point of the cover rather than upwardly at its rearward end.

It will be noted from FIG. 3 of the drawings that as the paper is fed from the interior of the case its inner surface passes around and is engaged by the curved surface 56, and the outer surface of the paper is trained around and is engaged by the ramp 62.

Preferably the case is constructed of a material having sufficient conductivity that when provided with a ground wire, as shown in FIG. 5 of the drawings at 70 with a ground clip 72 for attachment to a ground, automatic dissipation occurs of static electricity which would otherwise accumulate as the paper is fed from storage to a printer.

The cover is provided with ribs 74 which project upwardly and prevent inadvertent slippage of the printer off either side of its stand. Additionally, it will be noted that the feet 22 are displaced inwardly somewhat along the bottom surface of the base 18 in a position to nest inwardly of the ribs 74 to permit stacking of several of the cases of the present invention for storage or multiple form feeding.

Note also that the upper surface of the cover may be recessed, as indicated at 76, to receive a printer and permit the cover to be raised for access to the paper supply without substantial risk of the printer sliding rearwardly off the printer stand.

From the preceding description it will be seen that the present invention provides a combined form feed and storage, printer stand and carrying case, which permits the manufacturer or distributor to package a printer in the case for shipment to a point of distribution, permits the purchaser to carry the case by the carrying handle 52 and then set the case up with the printer paper received therein and fed to a printer positioned on top of the case, which now functions as both a printer stand and storage and feed case.

While the article herein described constitutes a preferred embodiment of the invention, it is to be understood that the invention is not limited to this precise article and that changes may be made therein without departing from the scope of the invention which is defined in the appended claims.

What is claimed is:

1. A compact, combined form feed and storage, printer stand and carrying case comprising:

a bottom wall and a plurality of lower walls extending upwardly from said bottom wall and defining therewith a hollow base, a top wall and a plurality of upper walls depending downwardly therefrom and defining therewith a hollow cover, said upper and lower walls including corresponding rear and side walls, means defining a front opening into said hollow base and cover opposite said back walls and between said side walls thereof, front supporting means on said cover adjacent said opening for supporting a continuous web substantially across its width, rear supporting means on said cover adjacent said rear wall thereof for supporting a continuous web substantially across its width, and means defining a path for such web from said front to said rear supporting means substantially along said top wall.

2. The combination of claim 1 further comprising a front cover selectively movable to substantially close said front opening.

3. The combination of claim 2 further comprising means hingedly attaching said front cover to said printer stand and carrying case.

4. The combination of claim 3 further comprising means defining a viewing window in said front cover.

5. The combination of claim 1 further comprising means hingedly interconnecting said base and said cover.

6. The combination of claim 1 wherein said front supporting means comprises an elongated, curved surface extending across said cover adjacent said front opening for engaging an inner surface of a continuous web trained thereover.

7. The combination of claim 6 wherein said rear support means includes an elongated surface extending across said cover adjacent said rear wall thereof for engaging an outer surface of a continuous web trained over said front and rear support means.

8. The combination of claim 1 wherein said path defining means for said web comprises an opening extending through said cover across its width from adjacent said front to said rear support means.

9. The combination of claim 8 further comprising means defining a slot extending substantially across said top wall intermediate of and substantially parallel to said front and rear support means and communicating said opening with ambient.

10. The combination of claim 9 further comprising ramp means disposed intermediate said slot and said rear supporting means.

11. The combination of claim 1 further comprising means for electrostatically discharging a web of paper passing over said front and rear supporting means.

12. The combination of claim 11 wherein said electrostatically discharging means comprises forming at least said front and rear supporting means of a conductive material.

13. The combination of claim 12 wherein said electrostatically discharging means further comprises ground wire means attached to said case.

14. The combination of claim 1 further comprising means defining upstanding ribs along opposite sides of said top wall.

15. The combination of claim 1 further comprising a carrying handle on one of said side walls.

16. The combination of claim 1 further comprising latch means on at least one of said side walls.

17. The combination of claim 1 wherein at least said top and bottom walls are of dual construction.

18. A compact, combined form feed and storage, printer stand and carrying case comprising:

a bottom wall, a pair of side walls extending upwardly from opposite sides of said bottom wall and a rear wall extending upwardly from a rear edge of said bottom wall and defining a hollow base of sufficient length and width to accommodate a computer printer therein, a top wall, a pair of upper side walls depending downwardly from opposite sides thereof and a rear wall depending downwardly from a rear edge of said top wall and defining therewith a hollow cover complementary to said hollow base, at least said top and bottom walls being of dual construction, means hingedly interconnecting said base and cover adjacent edges of their respective rear walls, means defining a front opening into said hollow base and cover opposite said back walls thereof and between said side walls thereof, a front cover hingedly attached to said bottom wall along a lower edge of said front cover for selective movement thereof into and out of said front opening, means defining a viewing window in said front cover to permit observation of the contents of said combined printer stand and carrying case, an elongated curved surface extending across said cover adjacent said front opening thereof for engaging an inner surface of a continuous web received in said hollow base and trained upwardly about said elongated curved surface, means defining an opening through said cover across the width thereof from adjacent said front opening to said rear wall of said cover and defining a path for said web through said cover from the front to the rear thereof, an upwardly extending ramp positioned at a downstream end of said opening and extending across said cover for engaging an inner surface of said continuous web passing through said path in said cover, said case being formed of a conductive material, ground wire means attached to said case, whereby passage of inner and outer surfaces of said web over portions of said case discharges electrostatic energy associated therewith, said dual wall construction of said top wall defining a slot extending across said top wall intermediate of and substantially parallel to said curved surface and said ramp, means for selectively interconnecting said front cover and said hollow cover, and a carrying handle mounted on at least one of said side walls.

* * * * *